US007270718B2

(12) United States Patent
Nishijima et al.

(10) Patent No.: US 7,270,718 B2
(45) Date of Patent: Sep. 18, 2007

(54) METHOD FOR MANUFACTURING A SOFT MAGNETIC POWDER MATERIAL

(75) Inventors: Yoshiaki Nishijima, Toyokawa (JP); Yurio Nomura, Nagoya (JP); Kouichi Yamaguchi, Kyoto (JP); Yuuichi Ishikawa, Kyoto (JP); Hidekazu Hayama, Kyoto (JP)

(73) Assignee: DENSO Corporation, Kariya (JP)

( * ) Notice: Subject to any disclaimer, the term of this patent is extended or adjusted under 35 U.S.C. 154(b) by 0 days.

(21) Appl. No.: 10/993,502

(22) Filed: Nov. 19, 2004

(65) Prior Publication Data

US 2005/0133116 A1 Jun. 23, 2005

(30) Foreign Application Priority Data

Nov. 20, 2003 (JP) ..... 2003-391318

(51) Int. Cl.
*H01F 1/20* (2006.01)

(52) U.S. Cl. ..... 148/105; 148/122; 148/284; 148/285

(58) Field of Classification Search ..... None
See application file for complete search history.

(56) References Cited

U.S. PATENT DOCUMENTS 5,348,800 A * 9/1994 Moro et al. ..... 428/328
5,651,841 A * 7/1997 Moro et al. ..... 148/309
5,800,636 A * 9/1998 Tsukada et al. ..... 148/306
5,827,445 A * 10/1998 Yoshida et al. ..... 252/62.54
5,993,729 A * 11/1999 Lefebvre et al. ..... 419/2
6,620,376 B1 9/2003 Koch et al.
2004/0134566 A1* 7/2004 Iyoda et al. ..... 148/105
2006/0027950 A1* 2/2006 Ishitani et al. ..... 264/613

FOREIGN PATENT DOCUMENTS

| | | |
|---|---|---|
| JP | 2-274813 | 11/1990 |
| JP | 3-291304 | * 12/1991 |
| JP | 04-160102 | 6/1992 |
| JP | 4-230004 | * 8/1992 |
| JP | 5-36514 | 2/1993 |
| JP | 2003-510805 | 3/2003 |
| JP | 2004-162174 | 6/2004 |

OTHER PUBLICATIONS

Machine English Language Translation of Japanese Patent Document No. 05-036514.*
Official Action dated Jan. 9, 2007 in Japanese Application No. 2003-391318 with English translation.

* cited by examiner

*Primary Examiner*—John P. Sheehan
(74) *Attorney, Agent, or Firm*—Harness, Dickey & Pierce, PLC

(57) ABSTRACT

The invention provides a method for manufacturing a soft magnetic powder material covered by oxide layers at surfaces of the powder, by using a soft magnetic alloy powder containing a soft magnetic powder material and a second element such as Si having an oxidizing reactivity higher than iron, and heating the soft magnetic alloy powder in an atmosphere of a weak oxidizing gas by mixing a weak oxidizing gas in an inert gas, and oxidizing selectively the second element at surface layers of the powder while restraining an oxidation of iron to form thin oxide layers with high electrical resistance.

10 Claims, 9 Drawing Sheets

METHOD FOR MANUFACTURING A SOFT MAGNETIC POWDER MATERIAL

BACKGROUND OF THE INVENTION

1. Field of the Invention

The present invention relates to a method for manufacturing a soft magnetic powder material for preparing a soft magnetic material to be used as a core material, and the like, of a solenoid actuator and a transducer. Particularly, the present invention relates to a method for forming oxide layers with high electrical resistance at surfaces of a Fe-base soft magnetic powder.

2. Description of the Related Art

For example, a core material of the actuator is required to have high saturation magnetic flux density and high magnetic permeability, in order to increase a response speed of a solenoid valve of an internal combustion engine. The soft magnetic material to be used for the application is made by employing a cheap Fe-base soft magnetic powder with high saturation magnetic flux density as a raw powder, and sintering the powder. During the step, it is necessary to form a grain boundary segregation layer with high electrical resistance in a sintered structure, and make a sintered material with high magnetic permeability and high strength, in order to reduce a loss based on an eddy current. Hence, in recent years, technologies have been researched to manufacture a soft magnetic material, by sintering a press-molded material of a soft magnetic powder material with insulating films formed on surfaces of the soft magnetic powder, for a purpose of increasing magnetic permeability, decreasing Fe loss, and the like of the soft magnetic material.

For example, in a manufacturing method described in Japanese unexamined patent publication No. 05-036514 (pages 2, 3 etc.), Ni—Zn ferrite thin layers of a soft magnetic material are formed at surfaces of the soft magnetic powder, by initially adsorbing a metal ion by submerging an atomized Fe-base alloy powder in an aqueous solution of $NiCl_2$ and $ZnCl_2$, and then carrying out a ferritizing reaction via oxidation in air. Further, a magnetic composite powder is prepared, by sputtering Al in an atmosphere of nitrogen gas to form an AlN based insulating film on the Ni—Zn ferrite thin layer. After that, a molding material is obtained by adding a $B_2O_3$ powder to the magnetic composite powder and, after being press-molded in a desired shape, it is sintered at 1000 degrees Celsius under pressure by a hot press method.

However, in the manufacturing method described above, it costs much in time and effort, at a forming step of the soft magnetic Ni—Zn ferrite thin layers at surfaces of the atomized Fe-base alloy powder, and a forming step of the insulating film, by sputtering Al in an atmosphere of nitrogen gas. If a crack is caused in the insulating film, an isolating property between particles of the magnetic powder decreases, and Fe loss at the sintered soft magnetic material (loss based on an eddy current) increases. Alternatively, in a case that the insulating film is formed thickly to prevent the insulating film from cracking, there is a problem that a density of the magnetic material in the soft magnetic material decreases, the saturation magnetic flux density decreases, and magnetic properties become deteriorate.

SUMMARY OF THE INVENTION

The present invention has been carried out in consideration of these situations. It aims to manufacture, by a simple process, a soft magnetic powder material which comprises thin layers having high electrical resistance at surfaces of the powder containing cheap Fe as a major component, in order to obtain a soft magnetic component satisfying simultaneously requirements of high saturation magnetic flux density, high magnetic permeability, low Fe loss, high strength and productivity at a high level.

To achieve the object, one embodiment of the present invention is a method for manufacturing a soft magnetic powder material covered by oxide layers at surfaces of the powder, comprising a step of forming said oxide layer, by heating a soft magnetic alloy powder containing iron as a major component and a second element with higher oxidation reactivity than iron in an atmosphere of a weak oxidizing gas by mixing a weak oxidizing gas in inert gas, to oxidize mostly said second element at surfaces layer of the powder.

Another embodiment of the present invention is a method for manufacturing a soft magnetic powder material covered by oxide layers at surfaces of the powder, comprising a step of forming said oxide layers, by carrying out alternately an oxidizing step of heating in an atmosphere of a weak oxidizing gas by mixing a weak oxidizing gas in an inert gas, and a reducing step of heating, in a reducing atmosphere, a soft magnetic alloy powder containing iron as a major component and a second element with higher oxidation reactivity than iron, to oxidize mostly said second element at surface layers of the powder.

DETAILED DESCRIPTION OF THE INVENTION

Figure 1A:
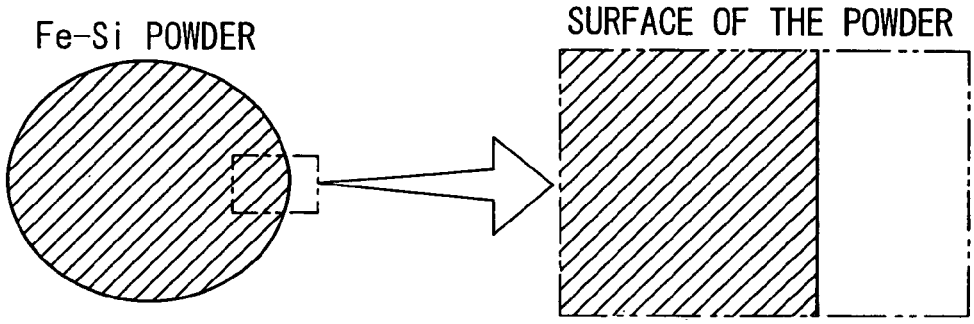
FIGS. 1(*a*), 1(*b*) are drawings to describe a method of Example 1 according to the present invention, wherein FIG. 1(*a*) shows a schematic drawing of a particle of a Fe—Si powder and an enlarged drawing of its surface, FIG. 1(*b*) shows a schematic drawing of a particle of a Fe—Si powder, of which an oxide layer was formed at the surface, and an enlarged drawing of its surface.

In order to achieve the purpose described above, in one aspect the method for manufacturing a soft magnetic powder material according to the present invention, an oxide layer is formed by using a soft magnetic alloy powder containing iron as a major component and a second element with higher oxidation reactivity than iron, heating the soft magnetic alloy powder in an atmosphere of a weak oxidizing gas formed by mixing a weak oxidizing gas in inert gas, and oxidizing mostly the second element at surface layers of the powder.

As described above, when the soft magnetic alloy powder is oxidized in an atmosphere of a weak oxidizing gas, it is possible to restrain oxidation of iron at surface layers of the soft magnetic alloy powder, and selectively oxidize only the second element which can be more easily oxidized. A dense thin oxide layer with high electrical resistance can be formed at the surface, by moderately restraining an oxidation speed. There is a high effect to reduce a loss (iron loss) based on an eddy current. In addition, as a magnetic material density increases by decreasing the thickness of the oxide layer, magnetic properties are improved. It becomes possible to increase its strength, by decreasing a particle size of the powder material. Further, the productivity is improved, as a manufacturing process can be simplified.

In another aspect of the method for manufacturing a soft magnetic powder material according to the present invention, an oxide layer is formed by carrying out, alternately, an oxidizing step of heating in an atmosphere of a weak oxidizing gas formed by mixing a weak oxidizing gas in an inert gas, and a reducing step of heating in a reducing atmosphere, a soft magnetic alloy powder containing iron as a major component and a second element with higher oxidation reactivity than iron, to oxidize mostly the second element at surface layers of the powder.

As described above, it also is possible to carry out the oxidizing reaction in an atmosphere of a weak oxidizing gas, and carry out the reducing reaction in a reducing atmosphere, and then repeat the oxidizing reaction. Under this process, it is possible to enhance oxidizing the second element at the surface layer while restraining to proceed with the oxidation into the inside, and form the oxide layer having higher purity and high electrical resistance. As a result, it becomes possible to decrease the iron loss of the magnetic material, and improve its magnetic properties and productivity.

Preferably, in the method according to the present invention, the second element comprises at least one element selected from a group consisting of Si, Ti, Al and Cr.

These elements are suitable as a raw material of the oxide layer, since Gibbs free energy $\Delta G$ at the oxidizing reaction is smaller than iron, and the oxidizing reaction can easily proceed.

Preferably, in the method according to the present invention, the weak oxidizing gas is steam or dinitrogen monoxide gas.

In oxidation via steam, the reaction speed becomes slower in comparison with in the atmosphere of air, since the oxidizing reaction proceeds in concert with a reducing reaction of $H_2O$. In particular, as the oxidizing reaction of iron reaches almost an equilibrium state, and the reaction becomes to proceed nearly little, it becomes possible to selectively oxidize only the second element which can be more easily oxidized. In a case also of dinitrogen monoxide gas, a similar reaction manner proceeds.

Preferably, in the method according to the present invention, the weak oxidizing gas is steam, and it is mixed into the inert gas so that relative humidity is higher than 50%.

Specifically describing, when steam is utilized, an atmosphere of a weak oxidizing gas can be easily formed. In particular, when oxidation is carried out in an ambient atmosphere with relative humidity of higher than 50%, the above-mentioned effect can be easily obtained.

Preferably, in the method according to the present invention, the weak oxidizing gas is steam, and it is mixed in the inert gas so that relative humidity can be from 70% to 100%.

When the oxidation is carried out in an atmosphere of steam with higher humidity, an oxide number density of the formed oxide layer increases, and the dense thin layer with high electrical resistance can be formed.

Preferably, in the method according to the present invention, the oxidation is carried out at a temperature of from 400 degrees Celsius to 900 degrees Celsius.

When a temperature of the ambient atmosphere is lower than the above-identified temperature range, the free energy variation $\Delta G$ for an oxidizing reaction system of iron via a weak oxidizing gas becomes less than zero, and the effect of restraining the reaction decreases. When a temperature of the ambient atmosphere is higher than the above-identified temperature range, although the oxidizing reaction of the second element becomes to easily proceed, there is a potential for properties of the obtained magnetic material to decrease. By defining the above-identified range, the dense oxide layer having a high oxide number density and a high electrical resistance can be formed.

Preferably, in the method according to the present invention, the soft magnetic alloy powder is an atomized alloy powder with an average particle diameter of from 0.01 micrometer to 500 micrometers.

As the particle diameters of the soft magnetic powder can increase by decreasing a thickness of the surface oxide layer described above, a strength of the soft magnetic material can increase, and the freedom of forming at a forming process can increase, by utilizing the atomized powder with suitable compressibility, and by adjusting the particle diameter in a range from 0.01 micrometer to 500 micrometers.

EXAMPLES

The best mode for carrying out the present invention is described based on specific examples as follows.

Example 1

In the present invention, the soft magnetic alloy powder used as a raw material contains iron (Fe) as a major component and a second element with higher oxidation reactivity than iron. Examples of the second element include Si, Ti, Al, Cr and the like. As the second element, a powder of an alloy containing at least one element, or two or more elements selected from a group of these elements, specifically e.g. Fe—Si alloy, Fe—Ti alloy, Fe—Al alloy, Fe—Cr alloy, Fe—Al—Si alloy or the like, is employed. Among these alloys, the Fe—Si alloy with a composition of e.g. Fe of 95-99.9% and Si of 0.1-5%, the Fe—Al alloy with a composition of e.g. Fe of 92.5-97.5% and Al of 2.5-7.5%, or the Fe—Al—Si alloy with a composition of e.g. Fe of 90-97%, Al of 3.5-6.5% and Si of 0.1-5% can be employed.

Herein, in general, the composition ratio of Si, Al and the like is determined by considering the following three factors.

(1) In order to improve magnetic properties, lower contents of Al, Si and the like are better.

(2) The contents of Al, Si and the like should be within a range of the solid solubility limit where no intermetallic compound is formed.

(3) The thickness of the oxide layer should be not less than a thickness by which a target value of electric resistance can be obtained.

For example, in order to improve the magnetic properties as described in (1) above, it is preferred that the composition ratio of these elements is not more than 2%, preferably not more than 1%. It is preferred to select the minimum composition ratio within this range, where a sufficient oxide layer can be formed. Two or more kinds of the soft magnetic alloy powders may be used, by blending them.

The soft magnetic alloy powder used as a raw material is preferably utilized as an atomized alloy powder prepared by an atomization method for pulverizing a molten alloy by using an atomizing medium such as water, inert gas and the like. As the atomized alloy powder has high purity and good compressibility, a soft magnetic material having high density and good magnetic properties can be realized. The average particle diameter of the soft magnetic alloy powder is generally adjusted in the range of not more than 500 micrometers, preferably from 0.01 micrometer to 10 micrometers. The soft magnetic alloy powder is prepared by pulverizing using a pulverizing equipment (attriter) to have a desired average particle diameter. In this pulverizing step, highly active fracture surfaces are formed in surfaces of the soft magnetic powder. The more preferable range of the average particle diameter of the soft magnetic alloy powder is 0.01-5 micrometers. As a raw material for manufacturing the soft magnetic alloy powder, a material before being annealed is used so that it can be easily pulverized. While it is pulverized, it is preferred to cool a stainless steel container for pulverization by water, in order to prevent the temperature of the soft magnetic powder from rising by the pulverization heat.

The soft magnetic alloy powder to be used as a raw material may be obtained, by employing solely each of a case of using the atomized powder prepared by the atomization method described above, and a case of using particles pulverized by using the pulverizing equipment (attriter) described above.

Figure 1B:
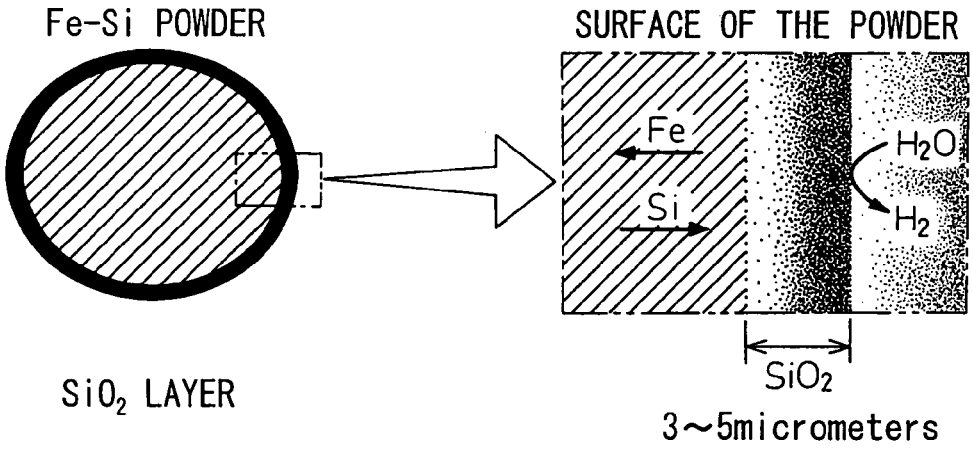

After that, oxide layers are formed at surfaces of the soft magnetic alloy powder. This step for oxidizing the surface, which is a characteristic part of the present invention, is to heat the soft magnetic alloy powder at a high temperature in an atmosphere of a weak oxidizing gas formed by mixing a weak oxidizing gas in an inert gas, and to oxidize mostly the second element at surface layers of the powder. For example, nitrogen gas ($N_2$) and the like are preferably used as the inert gas, and for example, steam ($H_2O$) is used as the weak oxidizing gas. FIGS. 1(*a*) and (*b*) show a case where Fe—Si alloy powder is oxidized via steam ($H_2O$). At surfaces of the powder, more easily oxidizable Si is selectively oxidized to form a $SiO_2$ layer, as well as $H_2O$ is reduced to form $H_2$. Under such a condition, as oxidation of Fe is restrained, and an oxidation speed is also suitably restrained, the $SiO_2$ layers with high electrical resistance covering the surfaces can be uniformly formed with a thickness of e.g. 3-5 micrometers.

As described above, gas of an oxidized compound in which a reducing reaction proceeds, as well as an oxidizing reaction proceeds, is preferably used as the weak oxidizing gas. For example, even if dinitrogen monoxide ($N_2O$) gas is used as the gas having a similar reaction mode, the same effect can be obtained.

In a case where the weak oxidizing gas is steam ($H_2O$), it is preferred to increase a relative humidity at an ordinary temperature to more than 50%, when the steam is mixed into the ambient atmosphere. The higher the relative humidity is, the oxidizing reaction of the second element such as Si, Al and the like at the surface layers of the powder is promoted stronger, and an oxide number density in the oxide layer is increased to form an insulating dense oxide layer with high electrical resistance. Preferably, it is preferred to mix steam into the ambient atmosphere so that the relative humidity becomes 70-100% at the ordinary temperature.

A general heating oven such as an and the like is utilized as a means for heating at a surface-oxidizing step. For example, in a case of forming the oxide layer in the electric oven, a thickness of the oxide layer may be adjusted by controlling a temperature of the ambient atmosphere (a heating temperature), a heating period, contents of Si and Al in the soft magnetic alloy powder. It is preferred to adjust the ambient atmosphere temperature, in general, in the range of 400-900 degrees Celsius, as appropriate. By increasing the temperature to 400 degrees Celsius or more, Gibbs free energy $\Delta G$ for an oxidizing reaction of iron can become close to zero, and an effect of restraining the oxidation of iron can be obtained. Although it becomes easy to form the oxide layer by increasing the ambient atmosphere temperature, it is preferred to adjust the temperature not higher than 900 degrees Celsius, since there is a potential for the properties of an obtained magnetic material to decrease. Preferably, it is preferred to adjust the ambient atmosphere temperature in the range of 400-700 degrees Celsius.

Figure 2:
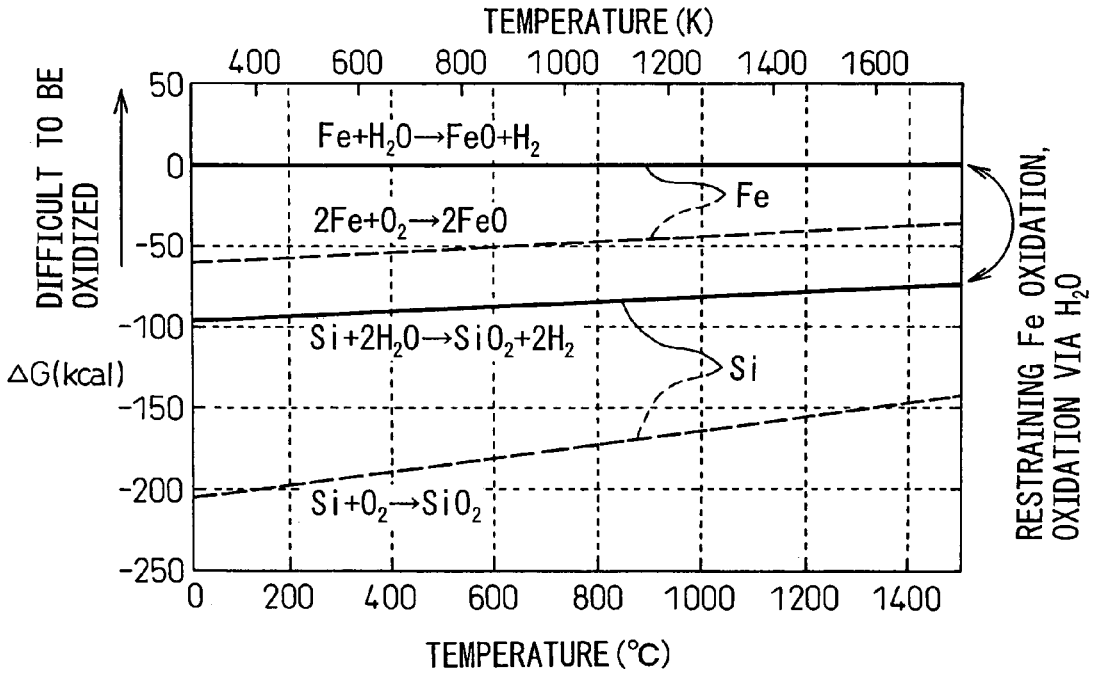
FIG. 2 is a drawing to describe a method of Example 1 according to the present invention in comparison with a conventional method, wherein free energy variation ΔG for an oxidizing reaction of Fe and Si is shown.

Herein, a mechanism of forming the oxide layers on a Fe—Si alloy powder in an atmosphere of a weak oxidizing gas is described. FIG. 2 shows both of oxidation reactivity of Fe and oxidation reactivity of Si in an atmosphere of oxygen ($O_2$) and in an atmosphere of steam ($H_2O$), by comparing each other. Formulae of oxidizing reactions of Fe and Si in each ambient atmosphere can be described as follows.

In a case of oxidation via oxygen ($O_2$), $$2Fe+O_2 \rightarrow 2FeO \quad \text{(Formula 1)}$$

$$Si+O_2 \rightarrow SiO_2 \quad \text{(Formula 2).}$$

In a case of oxidation via steam ($H_2O$), $$Fe+H_2O \rightarrow FeO+H_2 \quad \text{(Formula 3)}$$

$$Si+2H_2 \rightarrow SiO_2+H_2 \quad \text{(Formula 4).}$$

Figure 3A:
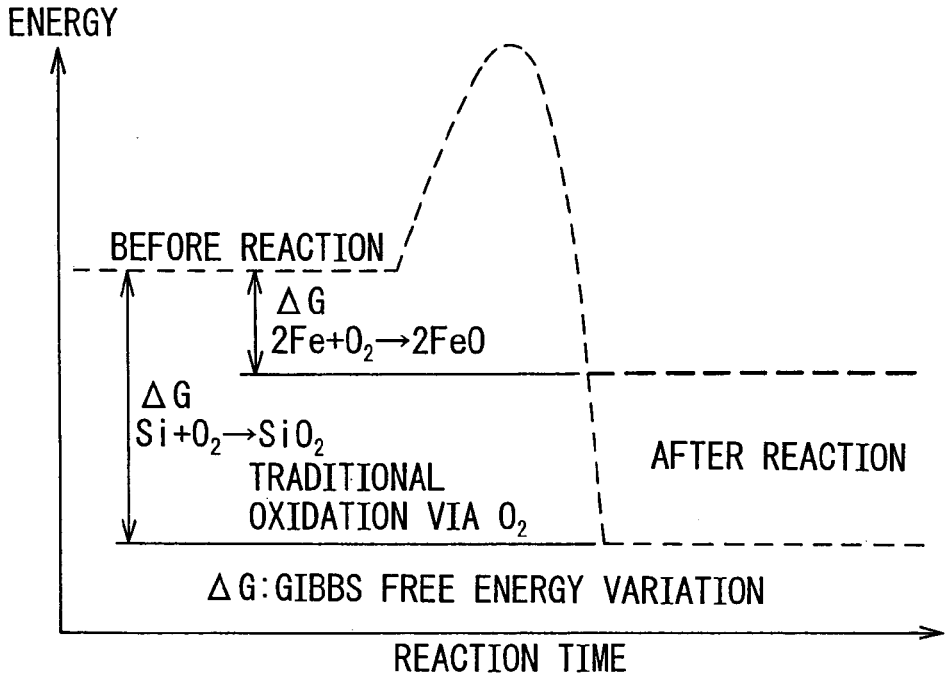
FIG. 3(*a*) is a drawing to describe free energy variation ΔG for an oxidizing reaction system via oxygen, and FIG. 3(*b*) is a drawing to describe free energy variation ΔG for an oxidizing reaction system via steam.
Figure 3B:
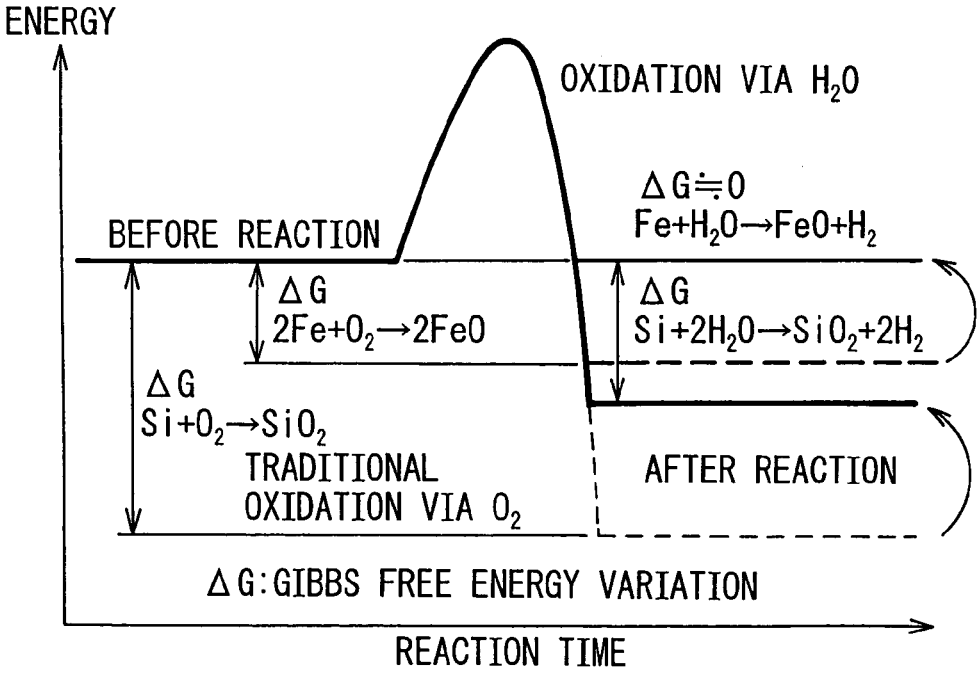

A vertical line of FIG. 2 is Gibbs free energy variation $\Delta G$ in each reaction system. The more $\Delta G$ increases, the oxidation becomes more difficult to proceed. FIG. 2 shows that the oxidation of Fe is more difficult than the oxidation of Si, and the oxidizing reaction (Formulae 3 and 4) via steam ($H_2O$) is more difficult than the oxidizing reaction (Formulae 1 and 2) via oxygen ($O_2$). This situation is described in FIG. 3. As shown in FIG. 3, at the oxidation via oxygen ($O_2$) for both cases of Fe and Si, the free energy after the reaction is lower than the free energy before the reaction, the system after the reaction is more stable. In other words, as shown in FIG. 2, the Gibbs free energy ΔG is minus for every case. Although Si having a large absolute value of ΔG is more easily oxidized than Fe, both reactions described in Formulae 1 and 2 proceed.

On the other hand, as shown in FIG. 3(*b*), at the oxidation via steam ($H_2O$) for both cases of Fe and Si, an absolute value of Gibbs free energy ΔG is lower than at the oxidation via oxygen ($O_2$). In particular, as the Gibbs free energy ΔG of Fe before and after the reaction becomes about zero, the reaction described in Formula 3 proceeds little, and only the reaction described in Formula 4 proceeds.

As described above, in a case of the oxidation via steam ($H_2O$), a $SiO_2$ oxide layer can be selectively formed while restraining the oxidation of Fe. As shown in FIG. 2, in a case of the oxidation of Fe via steam ($H_2O$), the effect of restraining the oxidation of Fe increases, since Gibbs free energy ΔG is close to zero in the all temperature range, and in particular in the range of 500 degrees Celsius or more, the Gibbs free energy ΔG of Fe becomes about zero. In a case of the oxidation of Si via steam ($H_2O$), as a reducing reaction of $H_2O$ simultaneously proceeds, the oxidation of Si is more difficult to proceed than in an atmosphere of oxygen ($O_2$), and the oxidation proceeds at an appropriate speed. Therefore, as the oxidation does not proceed into the inside, it is possible to keep the magnetic material density high, and uniformly form the $SiO_2$ oxide layer at surface layers of the powder to obtain a thin dense layer with high electrical resistance and a thickness of about several nanometers.

Figure 4A:
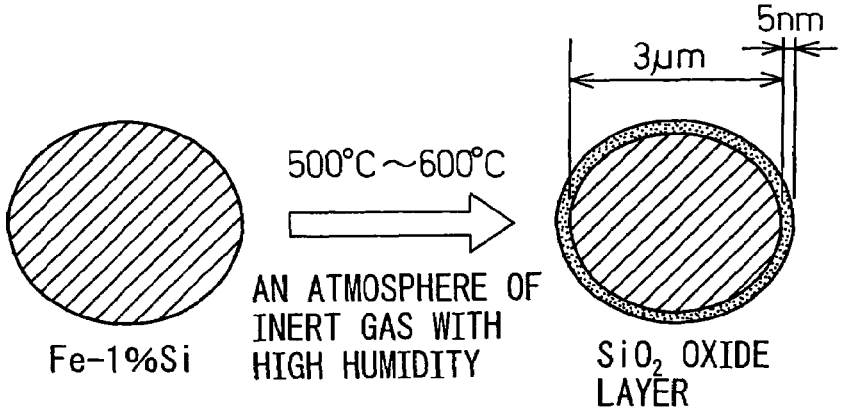
FIG. 4(*a*) is a drawing to describe a surface-oxidizing method of Fe—Si alloy powder by a method of Example 1 according to the present invention, and FIG. 4(*b*) is a drawing to describe a mechanism of the surface oxidation of Fe—Si alloy powder by a method of Example 1 according to the present invention.
Figure 4B:
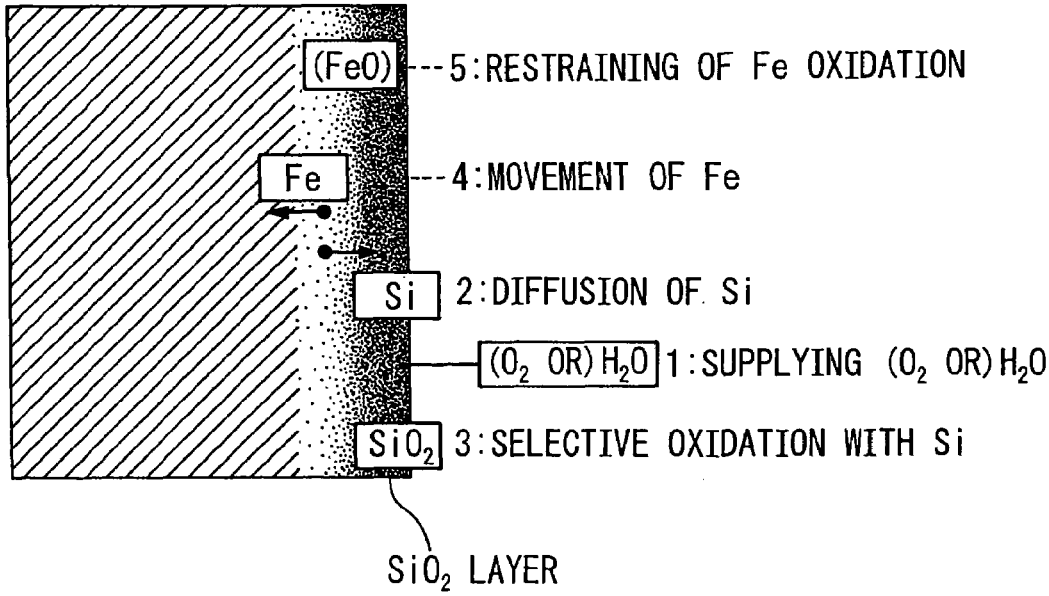

In FIG. 4(*a*), one example of a surface oxidation of the soft magnetic alloy powder according to the present invention is shown. Herein, a Fe-1% Si atomized alloy particle (being adjusted to have an average particle diameter of 3 micrometers) used as a raw material was heated at a temperature of 500-600 degrees Celsius in an atmosphere of an inert gas with high humidity (e.g. an atmosphere of nitrogen with relative humidity of 100%). FIG. 4(*b*) shows a situation of forming the oxide layers at the surface layers of the soft magnetic alloy powder. When steam ($H_2O$) is provided on the powder surfaces under the condition described above, Si, which is more easily oxidizable than Fe, reacts with $H_2O$ at the surfaces of the powder as described above. Then, as the content of Si at the surface decreases, Si diffuses from the inside to the surface, reacts with $H_2O$, and is selectively oxidized (see 1-3 of FIG. 4(*b*)). Due to this reaction, the surfaces of the Fe-1% Si alloy powder are uniformly covered with $SiO_2$ oxide layers.

Figure 5A:
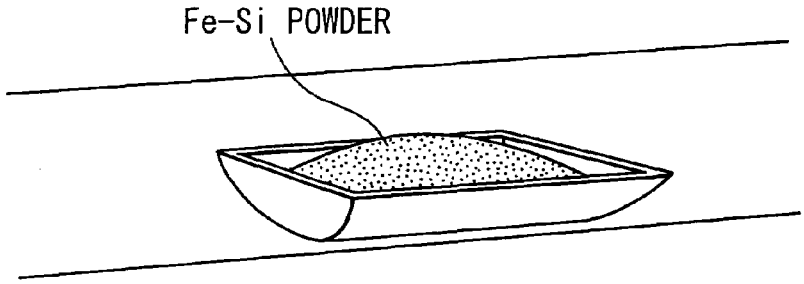
FIG. 5(*a*) is an enlarged drawing of FIG. 5(*b*), and FIG. 5(*b*) is a entire structural drawing of an equipment for preparing an oxide layer used in a method of Example 1.
Figure 5B:
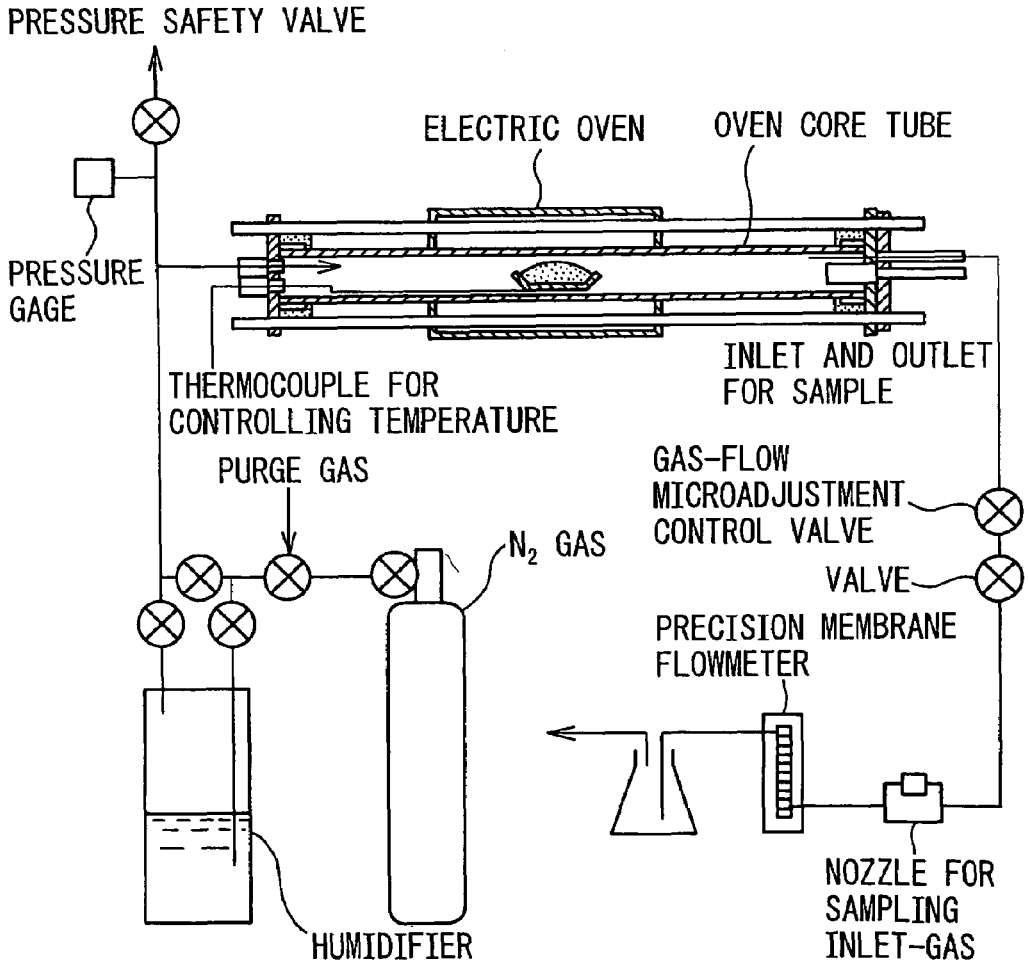
Figure 6A:
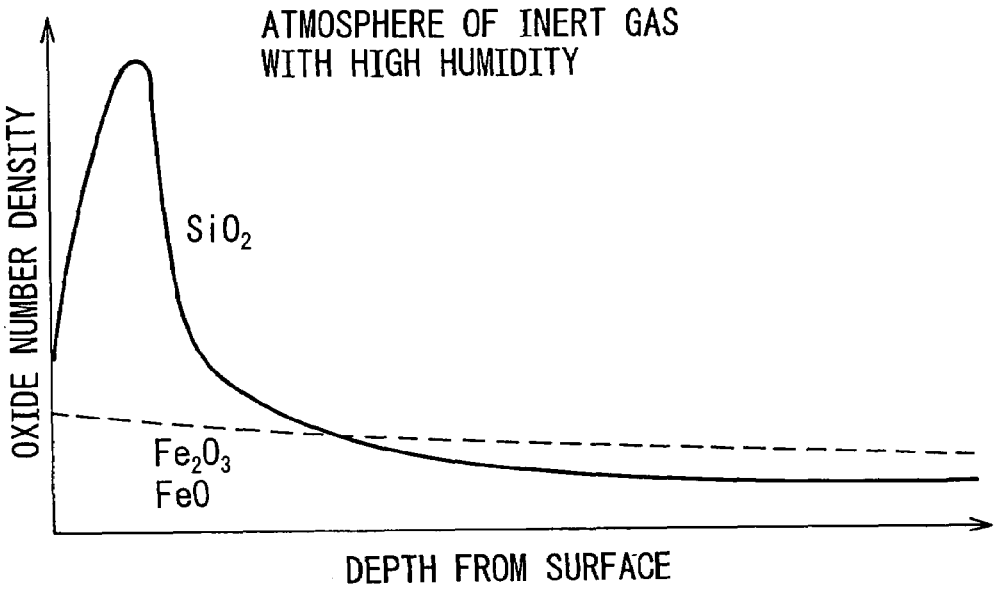
FIG. 6(*a*) is a drawing to describe a relation between the depth of the oxide layer from the surface of a particle of the powder and an oxide number density of an oxide layer, when the oxide layer was formed in an atmosphere of inert gas with high humidity, and FIG. 6(*b*) is a drawing to describe the relation between the depth of the oxide layer from the surface and the oxide number density, when the oxide layer was formed in the atmosphere of air.
Figure 6B:
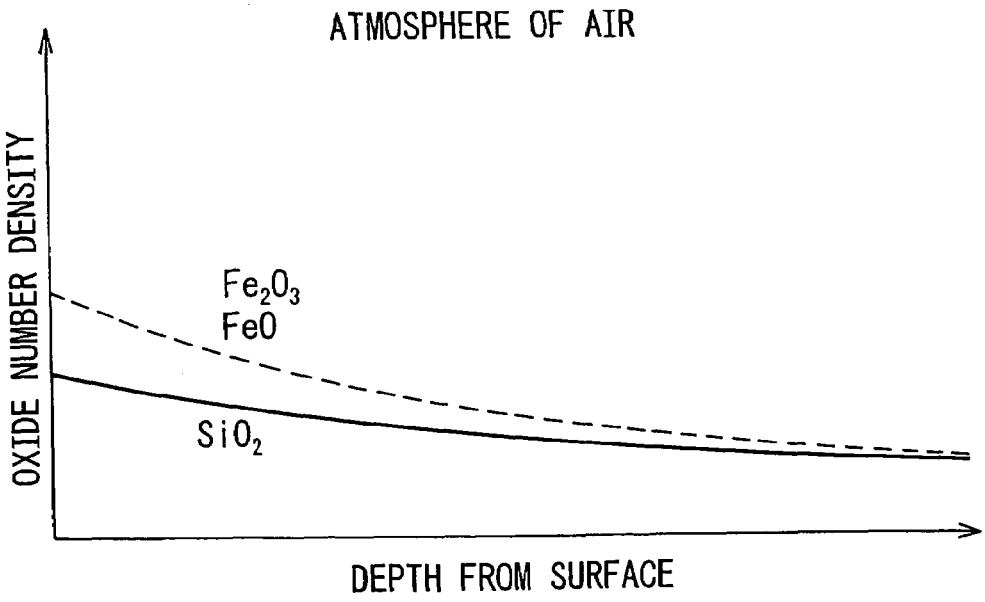

FIG. 5(*b*) shows an equipment of producing the oxide layer, which was utilized at that time. A raw powder was placed at the center of an oven core tube positioned in an electric oven (see FIG. 5(*a*)). Ambient gas, which had been prepared to have relative humidity of 100% by mixing steam ($H_2O$) into nitrogen ($N_2$) gas via a humidifier, was introduced into the oven core tube at a predetermined flow rate. $SiO_2$ oxide layers with a thickness of 5 micrometers were formed at surfaces of a Fe-1% Si alloy powder, by heating the inside of the electric oven at a temperature of 500-600 degrees Celsius using a thermocouple to control the temperature, and proceeding an oxidizing reaction for two hours. FIG. 6(*a*) shows variations of the depth of the oxide layer from the surface of a particle of the powder and an oxide number density at that time. FIG. 6(*b*) shows the variations of the depth of the oxide layer from the surface and an oxide number density, which were caused when a similar oxidizing reaction was carried out in the atmosphere of air.

As shown in FIG. 6(*a*), at a surface oxidation in an atmosphere of inert gas with high humidity, the $SiO_2$ oxide number density significantly increases at the surface layer, while a Fe oxide density is kept very low. In other words, as the $SiO_2$ oxide layer with high density can be selectively formed, even if it is a thin layer with about 5 nanometers thickness as described in FIG. 4(*a*), high electrical resistance can be realized. On the other hand, at a surface oxidation in the atmosphere of air, a Fe oxide number density at the surface layer is higher than a Si oxide number density. As described above, this situation is due to the fact that an oxidation of Fe cannot be restrained, and both of an oxidizing reaction of Fe and an oxidizing reaction of Si proceed at an oxidation via oxygen ($O_2$) gas.

Figure 7:
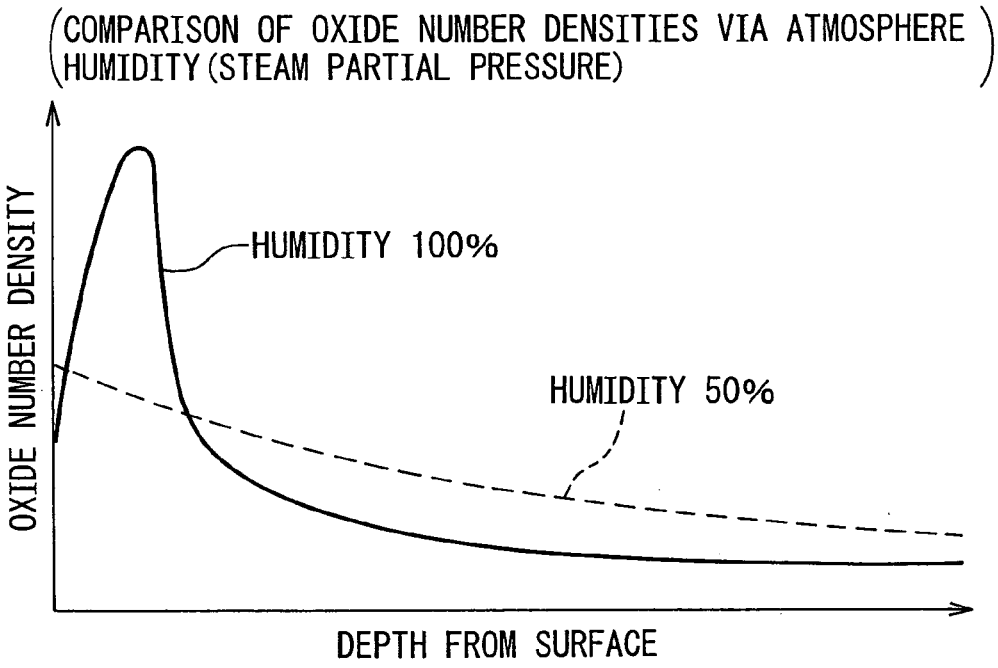
FIG. 7 is a drawing to describe a relation between the depth of the oxide layer from the surface and an oxide number density of an oxide layer, when the oxide layer was formed in an atmosphere with relative humidity of 100% or 50%.
Figure 8:
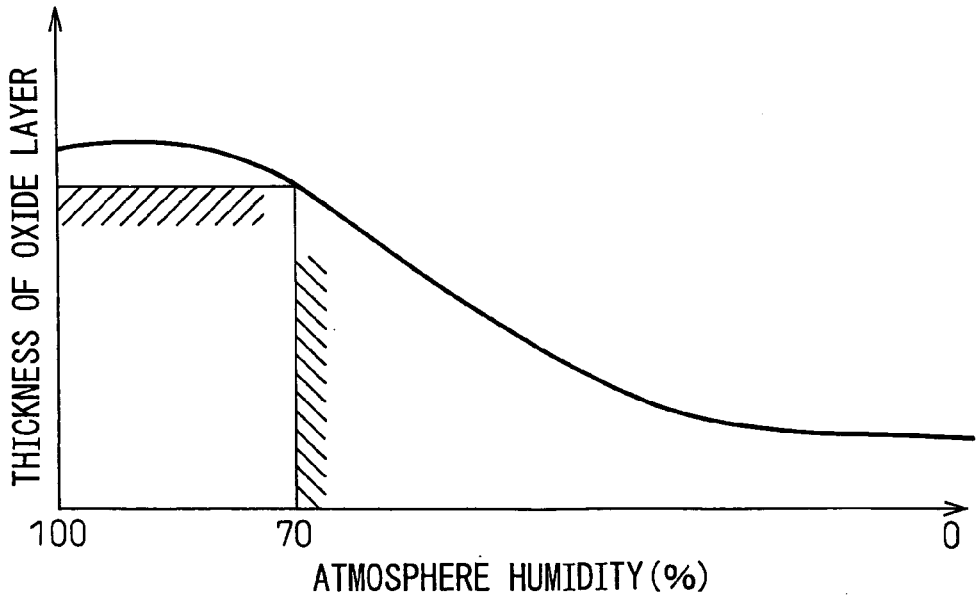
FIG. 8 is a drawing to describe a relation between humidity of an atmosphere and a thickness of a formed oxide layer, when the oxide layer was prepared by changing the humidity.

FIG. 7 shows the depth of the oxide layer from the surface of a particle of the powder and an oxide number density of a surface oxide layer, which was formed when oxidizing reactions were carried out in an atmosphere of inert gas mixed with steam at relative humidity of 100% or 50% under an ordinary temperature. As shown in FIG. 7, under a condition with relative humidity of 50%, the oxide number density of the surface decreases, and a good oxide layer does not form. Further, it is shown that the oxidation has proceeded into the inside, and the humidity gives strong influences to forming of the surface oxide layer. Generally, the thickness of the oxide layer formed relates to the humidity of the ambient atmosphere as shown in FIG. 8, and the oxide layer does not grow sufficiently under a condition with low humidity. When the relative humidity of the ambient atmosphere is about 70% or more, the oxide layer having an almost enough thickness can be obtained. Preferably, if the relative humidity is adjusted to about 100%, the oxide layer having an enough thickness and a high oxide number density can be obtained, and a targeting electrical resistance can be secured.

Thus, the soft magnetic alloy powder material, in which the surface oxide layer was formed, is used to form a molded product with a desired shape, by being applied to compression-molding in its natural state, or being applied to injecting a molding material, which has been fully kneaded after blending a binder, a solvent, an alloy powder and the like, into a molding tool, and carrying out the compression-molding under a pressure, in a step of press molding. A pressing pressure may be e.g. 980 Pa (10 ton/$cm^2$).

After that, a sintered product with a desired shape is obtained by sintering this molded product. A sintering step is carried out in a reducing atmosphere (e.g. an atmosphere of $H_2$), and the peripheries of the oxide layers at surfaces of the soft magnetic alloy powder are heated to a temperature of about 1200-1300 degrees Celsius, near a melting point. At the time, when millimeter wave sintering equipment is used as a means for heating, radiating millimeter wave energy locally acts on the periphery of the oxide layer having high electrical resistance, and efficiently locally heats only the periphery of the surface oxide layer to a temperature close to a melting point (particularly, a temperature not higher than the melting point), without increasing a temperature of the inside of a particle of the soft magnetic alloy powder. Thereby, the oxide layers of the soft magnetic alloy powder join diffusionally with one another, and the soft magnetic powder is unified as a sintered soft magnetic material.

As described above, in a case that the millimeter wave sintering equipment is used at the sintering step, even if the oxide layers at the surfaces of the soft magnetic alloy powder crack at the press molding step before the sintering step, the oxide layers grow up again and the cracks in the oxide layers are repaired at the subsequent sintering step, due to the oxide layers at the surfaces of the soft magnetic powder being locally heated to a temperature near the melting point. Accordingly, an insulation quality of the soft magnetic powder can be sufficiently secured, and a sintered soft magnetic material having a low iron loss can be obtained. If a discharge plasma sintering equipment is used as a means for heating instead of the millimeter wave sintering equipment, a similar effect can be obtained.

It is also possible to form surface oxide layers by locally heating the surfaces of the soft magnetic alloy powder through the use of a ordinary heating oven such as an electric oven and the like, millimeter wave sintering equipment or discharge plasma sintering equipment as a means for heating at a surface-oxidizing step. In general, as surfaces of the powder are hardly oxidized at a pulverizing step of the soft magnetic alloy powder, if the millimeter wave sintering equipment is used at the surface-oxidizing step, a millimeter wave energy radiated from the millimeter wave sintering equipment locally acts on surface oxidized parts of the soft magnetic alloy powder having high electrical resistance. Thus, the surfaces of the soft magnetic alloy powder are locally heated at a high temperature, and a thin oxide layer with a thickness of a level of several nanometers is uniformly formed at the surfaces of the soft magnetic alloy powder. The thickness of the oxide layer may be adjusted by the conditions of the millimeter wave equipment and the contents of Al and Si.

As described above, as the soft magnetic alloy powder material obtained in this example is covered by thin surface oxide layers with high electrical resistance, an insulation quality of the soft magnetic powder can be sufficiently secured, and a soft magnetic material with a low iron loss can be sintered. Due to decreasing the thickness of the oxide layer, a density of the magnetic material in the soft magnetic material can be increased, and an increased saturation magnetic flux density and an increased magnetic permeability can be realized. Further, magnetic properties can be improved. In addition, it becomes possible to decrease the particle diameters of the soft magnetic powder by decreasing the thickness of the oxide layer. As clarified from by the Hall-Petch Law described below, the strength can be increased, for example, by decreasing the average particle diameter of the soft magnetic powders to a range of 0.01-10 micrometers.

The Hall-Petch Law is $\sigma y=\sigma 0+k\times d^{-1/2}$ Herein, $\sigma y$ denotes a yield stress, k denotes a constant, d denotes the particle diameter of the soft magnetic powder, and $\sigma 0$ denotes an initial stress.

Further, a manufacturing process is simple, and productivity is also outstanding. A sintered product of the soft magnetic material obtained in this manner is useful as a various kind of soft magnetic components such as a solenoid valve of an internal combustion engine and a core material of a transducer.

Example 2

In Example 1 described above, the oxide layer was formed only by a heating process in an atmosphere of a weak oxidizing gas at the surface-oxidizing step. In this Example, a step of an oxidizing process in an atmosphere of a weak oxidizing gas by mixing a weak oxidizing gas in inert gas, and a step of a reducing process in a reducing atmosphere are alternately carried out. Herein, the step of an oxidizing process is carried out, in a similar manner to Example 1 described above, by heating the soft magnetic alloy powder to a high temperature of 400-900 degrees Celsius, preferably 500-600 degrees Celsius, in an atmosphere of a weak oxidizing gas formed by mixing a weak oxidizing gas in inert gas. Nitrogen ($N_2$) gas and the like are used as the inert gas, and the gas e.g. steam ($H_2O$), of which the relative humidity at an ordinary temperature is higher than 50%, preferably 70-100%, is used as the weak oxidizing gas.

Following that, the step of a reducing process is carried out by heating the soft magnetic alloy powder, of which oxide layers have been formed at the surfaces, to a high temperature of 400-900 degrees Celsius, preferably 500-600 degrees Celsius, in an atmosphere of reducing gas. As the reducing gas, for example, hydrogen ($H_2$) gas is preferably used. By alternately repeating these steps of an oxidizing process and a reducing process, the purity of the oxide layer is improved, and the thin oxide layer having higher density and higher electrical resistance can be uniformly formed.

Figure 9A:
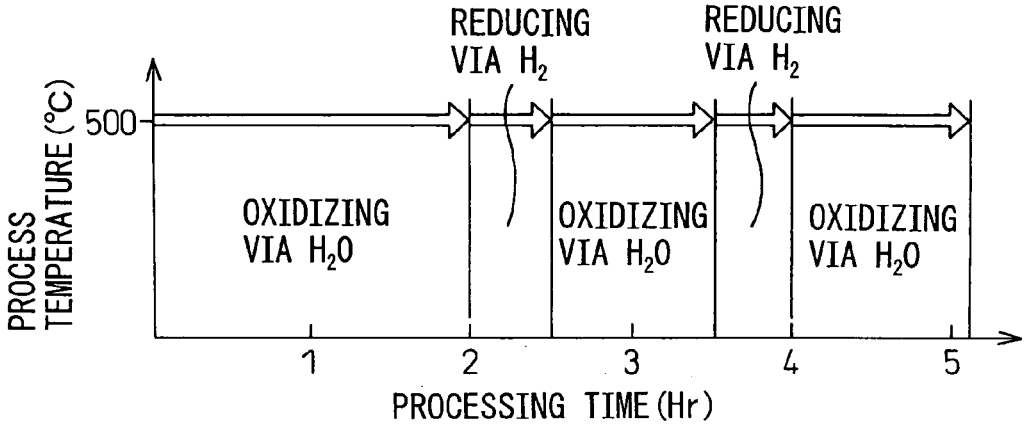
FIG. 9(*a*) is a drawing to describe a method of Example 2 according to the present invention, and FIG. 9(*b*) is a entire structural drawing of an equipment for preparing an oxide layer used in a method of Example 2.
Figure 9B:
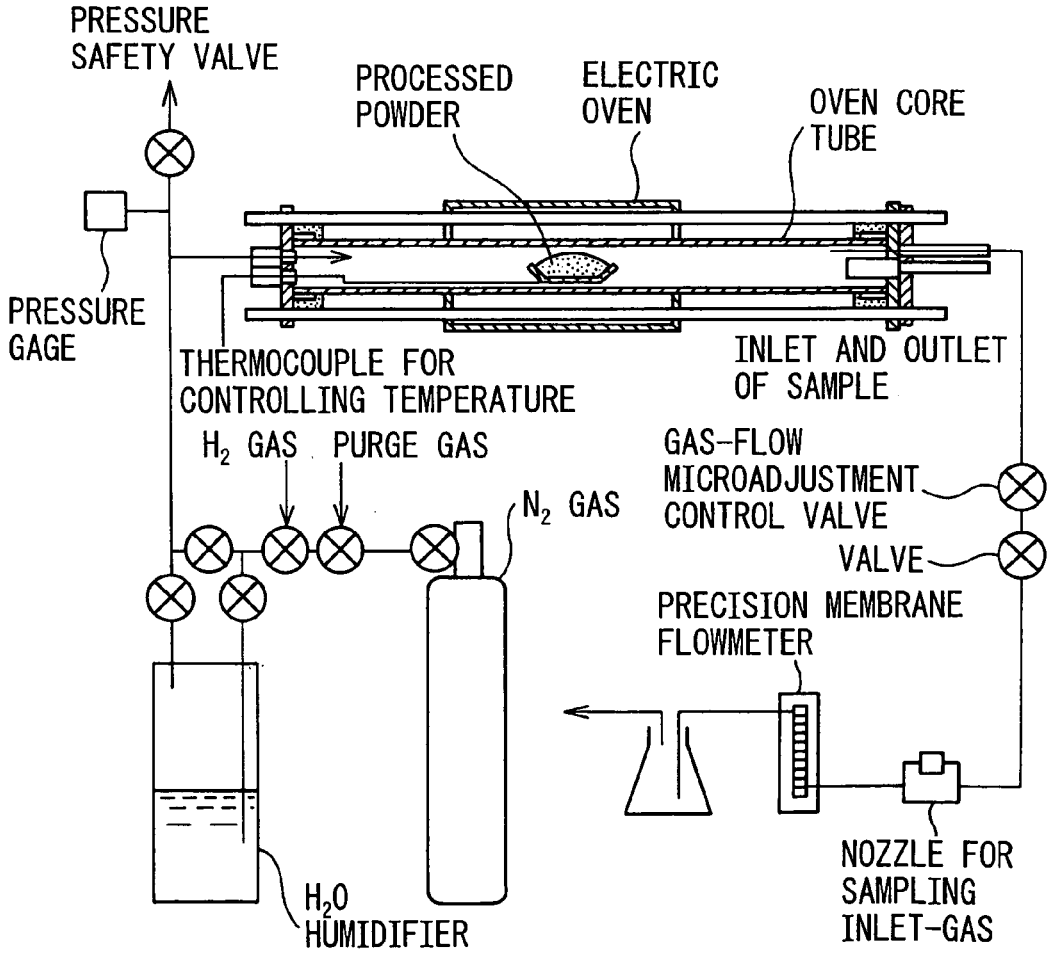

FIG. 9(*a*) shows one example of the surface-oxidizing step for the soft magnetic alloy powder according to the method in this Example. For example, by using the Fe-1% Si atomized alloy powder (with an average particle diameter of 3 micrometers) shown in FIG. 4(*a*) described above as a raw material, and repeating alternately the oxidizing process via steam ($H_2O$) and a reducing process via hydrogen ($H_2$) gas, a $SiO_2$ oxide layer was formed. FIG. 9(*b*) shows an equipment of forming the oxide layer, wherein an inlet conduit of hydrogen ($H_2$) gas is comprised in addition the equipment described in FIG. 5. A raw powder was placed at the center of an oven core tube positioned in an electric oven, the relative humidity of an atmosphere of gas was adjusted to 100% (at an ordinary temperature) by mixing steam ($H_2O$) into the gas via a humidifier, the powder was heated at 500 degrees Celsius, and an oxidizing reaction was carried out for 2 hours, then, the gas was purged by purging gas, hydrogen ($H_2$) gas was introduced, and a reducing reaction was carried out for 30 minutes at 500 degrees Celsius. After that, an oxidizing process via steam ($H_2O$) was carried out for 1 hour at 500 degrees Celsius, and further the reducing process via hydrogen ($H_2$) gas for 30 minutes at 500 degrees Celsius and the oxidizing process via steam ($H_2O$) for 1 hour at 500 degrees Celsius were alternately repeated.

Figure 10:
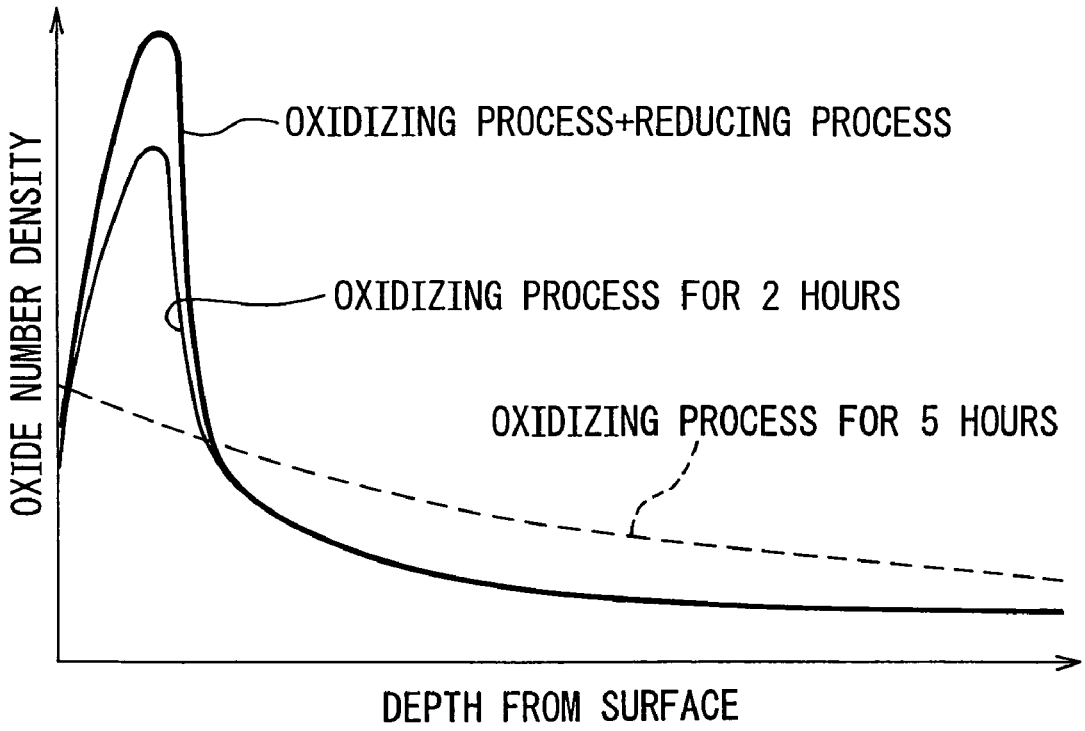
FIG. 10 is a drawing to describe a relation between the depth of the oxide layer from the surface and an oxide number density of an oxide layer, when the oxide layer was formed by an oxidizing process and a following reducing process according to the method of Example 2, in comparison with a case using only the oxidizing process.

FIG. 10 shows a relation between the depth of the oxide layer from the surface of a particle of the powder and an oxide number density of the oxide layer obtained by the method described in this Example. FIG. 10 shows also comparison of a result of a case where an oxidizing process via steam ($H_2O$) was carried out for 2 hours and a result of a case where the process was carried for 5 hours. As shown in FIG. 10, a good oxide layer with high oxide number density can be obtained by the oxidizing process for 2 hours. However, if the oxidizing process is further continued (oxidizing for 5 hours), the oxide number density at the surface layer decreases, and the oxide number density at the inside of a particle of the powder increases. This is deemed to be due to that $SiO_2$ at the surface layer diffuses into the inside. It can be understood that increasing of the density of the oxide layer is difficult, even if only the oxidizing process is continued for a long period. On the other hand, as the method described in this Example, when the reducing process is carried out after the oxidizing process, it is thought that the surface layer is exposed to the atmosphere of reducing gas, the diffusion of oxygen into the inside is restrained, and it becomes possible to increase the purity only at the surface layer.

As described above, according to the method of this Example, the soft magnetic alloy powder material, wherein the thin surface oxide layer with higher purity and higher electrical resistance is formed uniformly, can be obtained, and it becomes possible to manufacture a magnetic component with superior magnetic properties and high strength at a low cost.

What is claimed is:

1. A method for manufacturing a soft magnetic powder material covered by oxide layers at the surfaces of the powder, comprising a step of forming said oxide layers, by heating a soft magnetic alloy powder containing iron as a major component and a second element, which is at least one element selected from a group consisting of Si, Ti, Al and Cr with higher oxidation reactivity than iron in an atmosphere consisting of a weak oxidizing gas and an inert gas to oxidize mostly said second element at surface layers of the powder, wherein the weak oxidizing gas mixed into said inert gas is steam, and the oxidation is carried out under a condition of a temperature of 400-700° Celsius.

2. The method for manufacturing the soft magnetic powder material according to claim 1, wherein said second element is at least one element selected from a group consisting of Ti and Cr.

3. The method for manufacturing the soft magnetic powder material according to claim 1, wherein the oxidation is carried out under a condition of a temperature of 500-600° Celsius.

4. The method for manufacturing the soft magnetic powder material according to claim 1, wherein said soft magnetic alloy powder is an atomized alloy powder with an average particle diameter of 0.01-500 micrometers.

5. A method for manufacturing a soft magnetic powder material covered by oxide layers at the surfaces of the powder, comprising a step of forming said oxide layers, by carrying out alternately an oxidizing step of heating in an atmosphere of a weak oxidizing gas by mixing a weak oxidizing gas in an inert gas, and a reducing step of heating in a reducing atmosphere, a soft magnetic alloy powder containing iron as a major component and a second element with higher oxidation reactivity than iron, to oxidize mostly said second element at surface layers of the powder.

6. The method for manufacturing the soft magnetic powder material according to claim 5, wherein said second element comprises at least one element selected from a group consisting of Si, Ti, Al and Cr.

7. The method for manufacturing the soft magnetic powder material according to claim 5, wherein said weak oxidizing gas is steam or dinitrogen monoxide gas.

8. The method for manufacturing the soft magnetic powder material according to claim 5, wherein said weak oxidizing gas is steam,

9. The method for manufacturing the soft magnetic powder material according to claim 5, wherein the oxidation is carried out under a condition of a temperature of 400-900° Celsius.

10. The method for manufacturing the soft magnetic powder material according to claim 5, wherein said soft magnetic alloy powder is an atomized alloy powder with an average particle diameter of 0.01-500 micrometers.

* * * * *